US007520764B2

(12) United States Patent
Lee et al.

(10) Patent No.: US 7,520,764 B2
(45) Date of Patent: Apr. 21, 2009

(54) CABLE CONNECTOR FOR VEHICLE DOOR

(75) Inventors: Chul-Sub Lee, Daegu (KR); Kun-Tak Lim, Kyungsan-Si (KR); Gi-Chan Kwon, Kyungsan-Si (KR)

(73) Assignee: Tyco Electronics AMP Korea Ltd, Kyungsangbuk-Do (KR)

( * ) Notice: Subject to any disclaimer, the term of this patent is extended or adjusted under 35 U.S.C. 154(b) by 0 days.

(21) Appl. No.: 11/869,953

(22) Filed: Oct. 10, 2007

(65) Prior Publication Data

US 2008/0096407 A1 Apr. 24, 2008

(30) Foreign Application Priority Data

Oct. 18, 2006 (KR) ..... 10-2006-0101540

(51) Int. Cl.
*H01R 13/62* (2006.01)

(52) U.S. Cl. ..... 439/153; 439/347

(58) Field of Classification Search ..... 439/153, 439/557, 157, 160, 347
See application file for complete search history.

(56) References Cited

U.S. PATENT DOCUMENTS 4,586,771 A * 5/1986 Kraemer et al. ..... 439/325
4,973,268 A * 11/1990 Smith et al. ..... 439/595
5,391,086 A 2/1995 Woller et al.
5,660,556 A 8/1997 Badaroux et al.
6,183,275 B1 2/2001 Okura et al.
2003/0114044 A1 * 6/2003 Nakamura et al. ..... 439/557

FOREIGN PATENT DOCUMENTS

DE 29823075 U1 5/2000
JP 11-067350 3/1999
JP 11-260483 9/1999

* cited by examiner

*Primary Examiner*—Tho D. Ta
*Assistant Examiner*—Travis Chambers
(74) *Attorney, Agent, or Firm*—Barley Snyder LLC

(57) ABSTRACT

A cable connector for a vehicle door has a first connector including a first contact terminal and a fitting member. The fitting member has at least one cam recess, at least one locking recess, and at least one elastic member. The elastic member has at least one latching recess that engages an edge of a connecter mounting opening of a panel of a vehicle body. The contact terminal and the fitting member have a flange with a waterproof seal provided there between. A second connector is engaged with the fitting member of the first connector. The second connector includes a second contact terminal and a slide lever. The slide lever has at least one guide protrusion and at least one locking protrusion. The slide lever is slideable to move the guide protrusion along the cam recess and lock the locking protrusion in the locking recess.

4 Claims, 12 Drawing Sheets

CABLE CONNECTOR FOR VEHICLE DOOR

CROSS-REFERENCE TO RELATED APPLICATIONS

This application claims the benefit of the filing date under 35 U.S.C. § 119(a)-(d) of Korean Patent Application No. 10-2006-0101540, filed Oct. 18, 2006.

FIELD OF THE INVENTION

The present invention relates to cable connector for a vehicle door wherein the cable connector includes a first connector with a fitting member having at least one cam recess, at least one locking recess, and at least one elastic member and a second connector engaged with the fitting member of the first connector that is provided with a slide lever having at least one guide protrusion that moves along the cam recess and at least one locking protrusion that locks in the locking recess.

BACKGROUND

Generally, a door of a vehicle is provided with operating devices, such as a power window device, a door locking device, a side mirror adjusting device, etc., which operate by a power source. The respective operating devices are connected to a main controller mounted in a vehicle body through cables so as to be driven by the manipulation of a driver. The cables are drawn out from a side portion of the vehicle body and are put into the door. Typically, a panel of the vehicle body is provided with cable connectors to connect the cables drawn out from the vehicle body and the cables extending from the respective operating devices mounted in the door.

FIGS. 8-9 show an example of a conventional cable connector shown installed in a vehicle. As shown in FIG. 8, the conventional cable connector includes a first connector 300, which is connected with a cable 10 drawn out from an interior of a vehicle body 100, and a second connector 400, which is connected with a cable 10 drawn out from an interior of a vehicle door 200 and is inserted into the first connector 300. As shown in FIG. 9, the first connector 300 is provided with flanges 301 extending outwardly. In order to fixedly mount the first connector 300 to a panel 101 of the vehicle body 100 having a connector mounting opening 102, the flanges 301 are formed with fixing holes 302 through which bolts 303 are tightened.

When mounting the conventional cable connector, the first connector 300, connected with the cable 10 drawn out from the vehicle body 100, is fitted through the connector mounting opening 102 formed at the panel 101 of the vehicle body. Then, the flanges 301 of the first connector 300 are fixed to the panel 101 of the vehicle body 100 by tightening the bolts 303 through the fixing holes 302 formed at the flanges 301. Thereafter, the second connector 400 connected with the cable 10 drawn out from the door 200 is engaged with the first connector 300 thereby completing the process of assembling the cable connector.

However, the above conventional cable connector has a problem of taking much time to assemble the cable connector, because the first connector 300 is fixed to the panel 101 of the vehicle body 100 by tightening the bolts 303. Also, a worker has an inconvenience in assembling the cable connector because of using a motor-operated screwdriver in a small space between the vehicle body 100 and the vehicle door 200 to fix the first connector 300 to the vehicle body 100.

SUMMARY

It is an object of the present invention to provide a cable connector for a vehicle door that enables a worker to simply assemble a second connector and a first connector without using any coupling methods, such as a bolt. It is another object of the present invention to provide a cable connector for a vehicle door that enables a worker to install the first connector to a panel of a vehicle body without any mistake in a process of assembling the second connector and the first connector.

This and other objects are achieved by a cable connector for a vehicle door comprising a first connector including a first contact terminal and a fitting member. The fitting member has at least one cam recess, at least one locking recess, and at least one elastic member. The elastic member has at least one latching recess that engages an edge of a connecter mounting opening of a panel of a vehicle body. The contact terminal and the fitting member have a flange with a waterproof seal provided there between. A second connector is engaged with the fitting member of the first connector. The second connector includes a second contact terminal and a slide lever. The slide lever has at least one guide protrusion and at least one locking protrusion. The slide lever is slideable to move the guide protrusion along the cam recess and lock the locking protrusion in the locking recess.

DETAILED DESCRIPTION OF THE EMBODIMENT(S)

Figure 1:
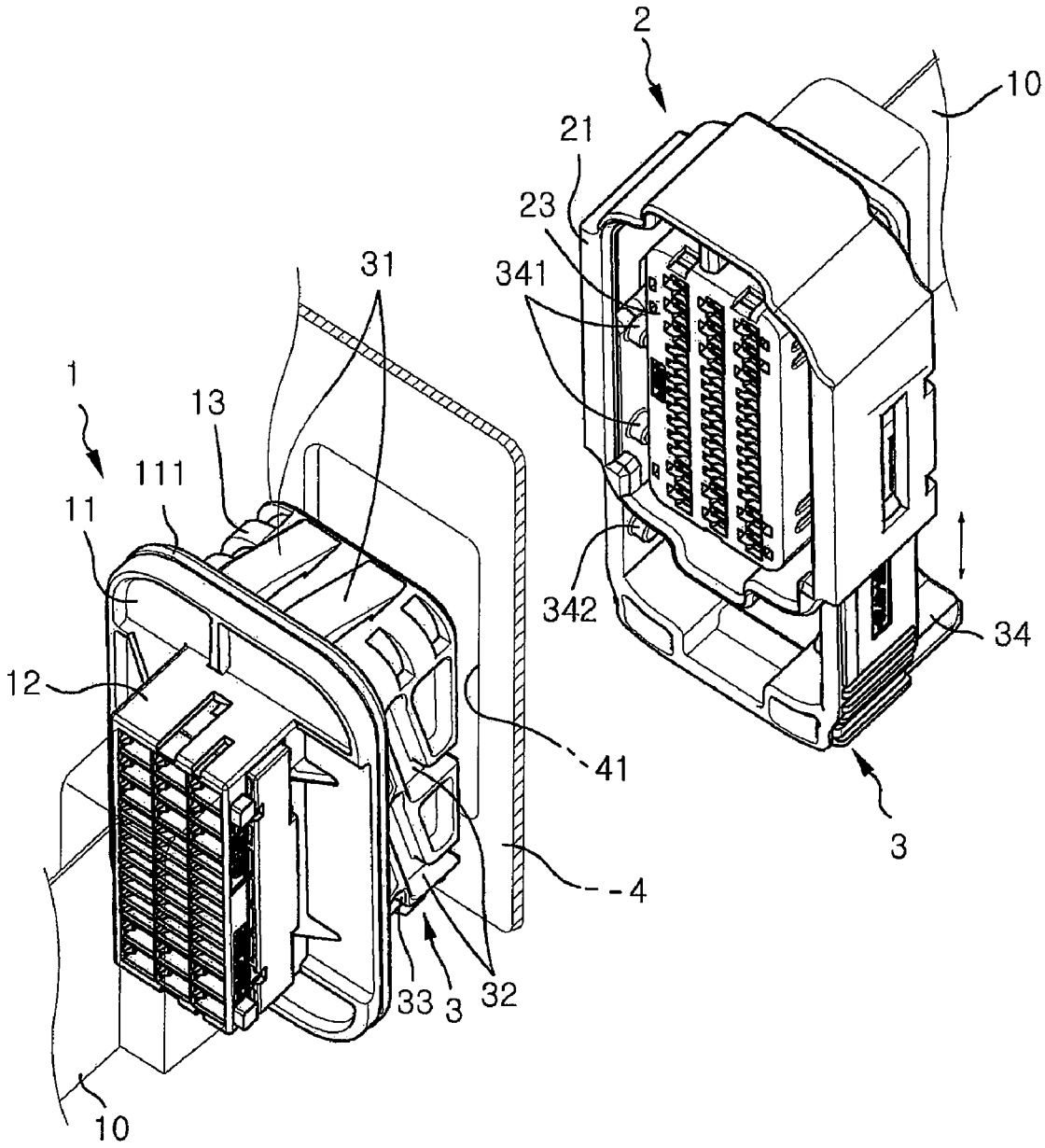
FIG. 1 is an exploded perspective view of a cable connector according to a first embodiment of the present invention.
Figure 2:
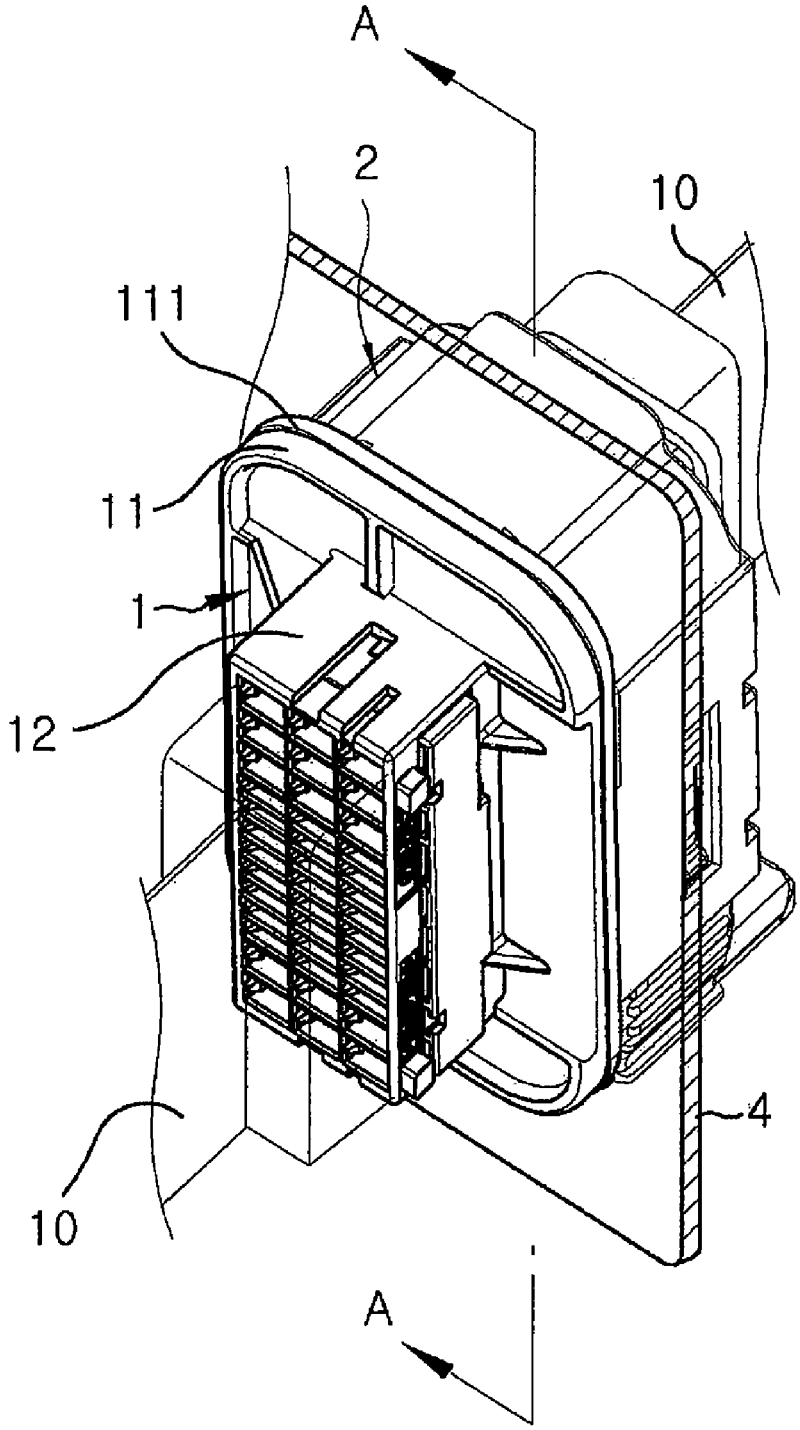
FIG. 2 is a perspective view of the cable connector of FIG. 1 shown in an assembled state.

FIGS. 1-3*b* show a cable connector according to a first embodiment of the present invention. As shown in FIG. 1, the cable connector includes a first connector 1, a second connector 2, and a connecting device 3. In the illustrated embodiment, the first connector 1 is a male connector, and the second connector 2 is a female connector. The first connector 1 includes a first contact terminal 12 and a fitting member 13. The first contact terminal 12 is configured to be connected with a cable 10, which is drawn out from a vehicle body. The fitting member 13 is configured to be fitted through a connector mounting opening 41 formed in a panel 4 of the vehicle body. A flange 11 is arranged between the first contact terminal 12 and the fitting member 13. The flange 11 has a waterproof seal 111. The waterproof seal 111 is provided on side portions of the flange 11 so that when the first connector 1 is fitted through the connector mounting opening 41 of the panel 4 of the vehicle body, the waterproof seal 111 closely contacts the panel 4 of the vehicle body around the connector mounting opening 41.

The second connector 2 includes a housing 21 provided with a second contact terminal 23. The second contact terminal 23 is configured to be inserted into the fitting member 13 of the first connector 1 and connected with a cable 10 drawn out from a vehicle door. The cables 10 drawn out from the vehicle body and the vehicle door are connected to each other through the engagement of the second connector 2 and the first connector 1.

Figure 3A:
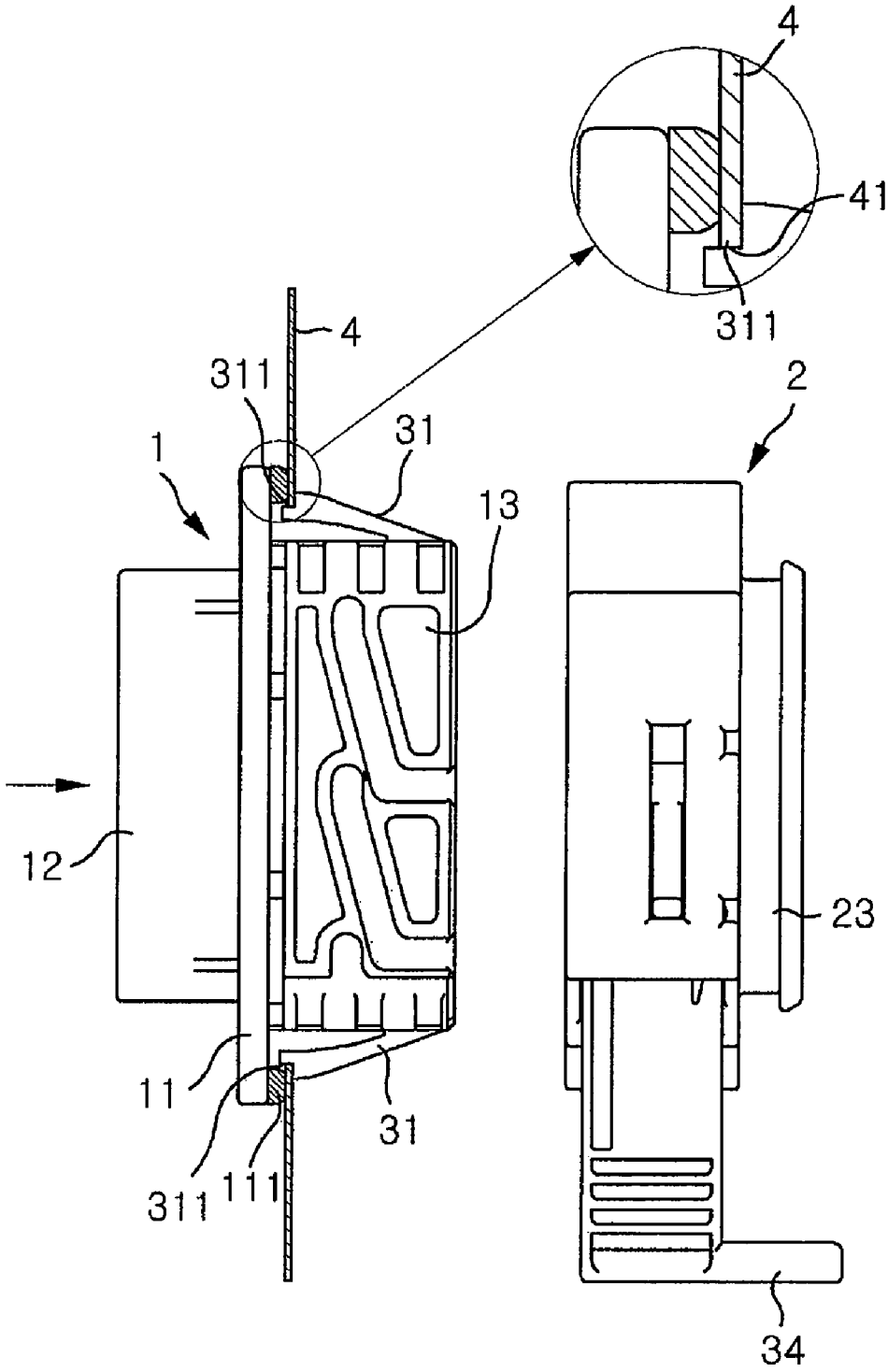
FIG. 3*a* is a schematic illustration of the cable connector of FIG. 1 shown being assembled to a panel of a vehicle body.

The connecting device 3 includes a plurality of elastic members 31, cam recesses 32, and locking recesses 33, which are formed on outer side surfaces of the fitting member 13 of the first connector 1. The elastic members 31 are provided with latching recesses 311 (FIG. 3*a*). The cam recesses 32 and the locking recesses 33 are formed substantially symmetrically on both outer side surfaces of the fitting member 13 of the first connector 1. A slide lever 34 is slidably provided in the second connector 2 and has guide protrusions 341 that move along the cam recesses 32 and locking protrusions 342 and are locked in the locking recesses 33. The guide protrusions 341 and the locking protrusions 342 are formed substantially symmetrically on both inner side surfaces of the slide lever 34.

Hereinafter, a process of assembling the cable connector according to the first embodiment of the present invention will be described with reference to FIGS. 3*a*-3*b*. As shown in FIG. 3*a*, the first connector 1 is installed in the panel 4 of the vehicle body by inserting the fitting member 13 of the first connector 1 through the connector mounting opening 41 from an interior of the panel 4 of the vehicle body to an exterior of the panel 4 of the vehicle body. When fitting the first connector 1 through the connector mounting opening 41, a worker pushes the first connector 1 until edges of the connector mounting opening 41 are fitted in the latching recesses 311 of the elastic members 31, which are formed on the outer surface of the fitting member 13.

The second connector 2 is temporarily engaged with the fitting member 13 of the first connector 1. Then, the slide lever 34 is pushed upward so that the guide protrusions 341 move along the cam recesses 32. As the slide lever 34 rises to an end thereof, the locking protrusions 342 are inserted in the locking recesses 33, thereby assembling the second connector 2 and the first connector 1.

Figure 3B:
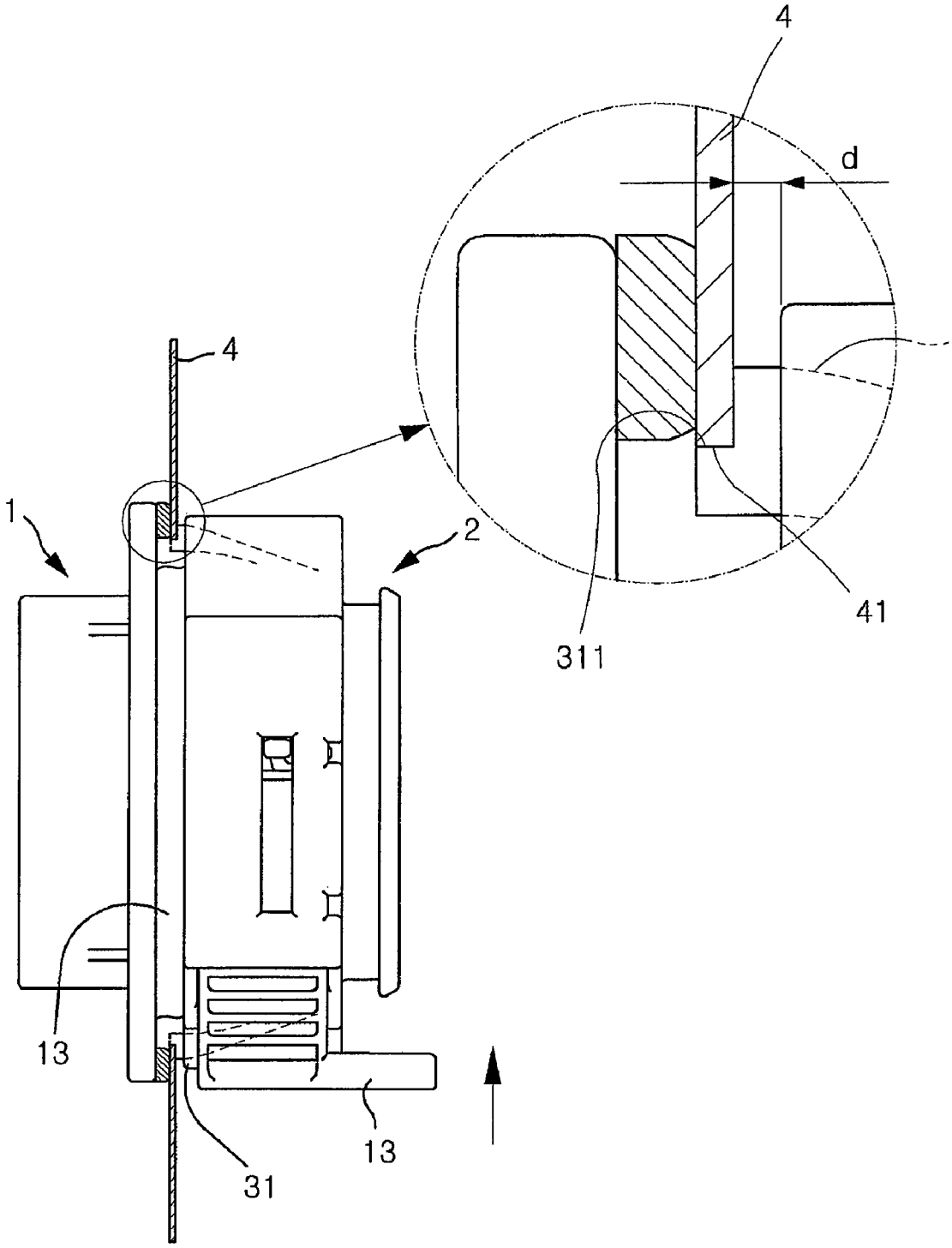
FIG. 3*b* is a schematic illustration of the cable connector of FIG. 1 shown assembled to the panel of the vehicle body.

On the other hand, as shown in FIG. 3*b*, it may occur that the slide lever 34 does not perfectly slide when assembling the second connector 2 and the first connector 1 due to an allowed tolerance generated in the manufacturing process of the cable connector and an accumulated tolerance generated in the assembling process of the cable connector. In other words, because of the allowed tolerance generated in the manufacture and the accumulated tolerance generated in the assembly, a distance between the end of the second connector 2 and the flange 11 of the first connector 1 gets narrow, which causes the slide lever 34 provided in the second connector 2 to not be perfectly locked.

To prevent this problem, the second connector 2 and the first connector 1 are manufactured so that when the second connector 2 and the first connector 1 are engaged, a gap having a distance d is formed between the end of the second connector 2 and a latching end at the latching recess 311 of the first connector 1. By this configuration, when the second connector 2 and the first connector 1 are engaged, the slide lever 34 can be perfectly locked. Accordingly, the assembly defect of the second connector 2 and the first connector 1 can be prevented in advance by manufacturing the second connector 2 and the first connector 1 so that the aforesaid distance d is larger than zero. As a result, the cable connector according to the first embodiment of the present invention has an advantage of improving assembly efficiency of the cable connector, by enabling a worker to securely install the second connector 2 and the first connector 1 to the panel 4 of the vehicle body by only the engaging process of the second connector 2 and the first connector 1 without using any coupling methods, such as a bolt.

However, when installing the first connector 1 through the connector mounting opening 41 of the panel 4 of the vehicle body, because a worker cannot sufficiently exert a pushing force on the first connector 1 due to a small inner space of the panel 4 of the vehicle body, a problem frequently occurs that the first connector 1 cannot be perfectly fitted through the connector mounting opening 41. Further, when fitting the first connector 1 through the connector mounting opening 41, because the latching recesses 311 of the elastic members 31 formed at the first connector 1 are very narrow and the waterproof seal 111 provided on the flange 11 generates a repulsive force, it is necessary to strongly push the first connector 1 at the last moment of fitting the first connector 1. However, because a worker cannot sufficiently exert a pushing force on the first connector 1 as described above, the assembly defect of the first connector 1 occasionally occurs.

Because of the above reason, a problem occurs that the second connector 2 is engaged with the first connector 1 while the end of the connecting mounting opening 41 is not fitted in the latching recesses 311 of the elastic members 31 formed at the first connector 1, which results in rattling of the cable connector after release of the vehicle or even results in separation of the cable connector from the panel 4 of the vehicle body. To prevent the above-described problem, a cable connector according to a second embodiment of the present invention has been devised.

FIGS. 4-7*c* show the cable connector according to the second embodiment of the present invention. The connector according to the second embodiment of the present invention includes substantially the same elements as the cable connector according to the first embodiment of the present invention and as such the elements will be identified by the same reference numerals and only variations there between will be described in further detail hereafter.

Figure 4:
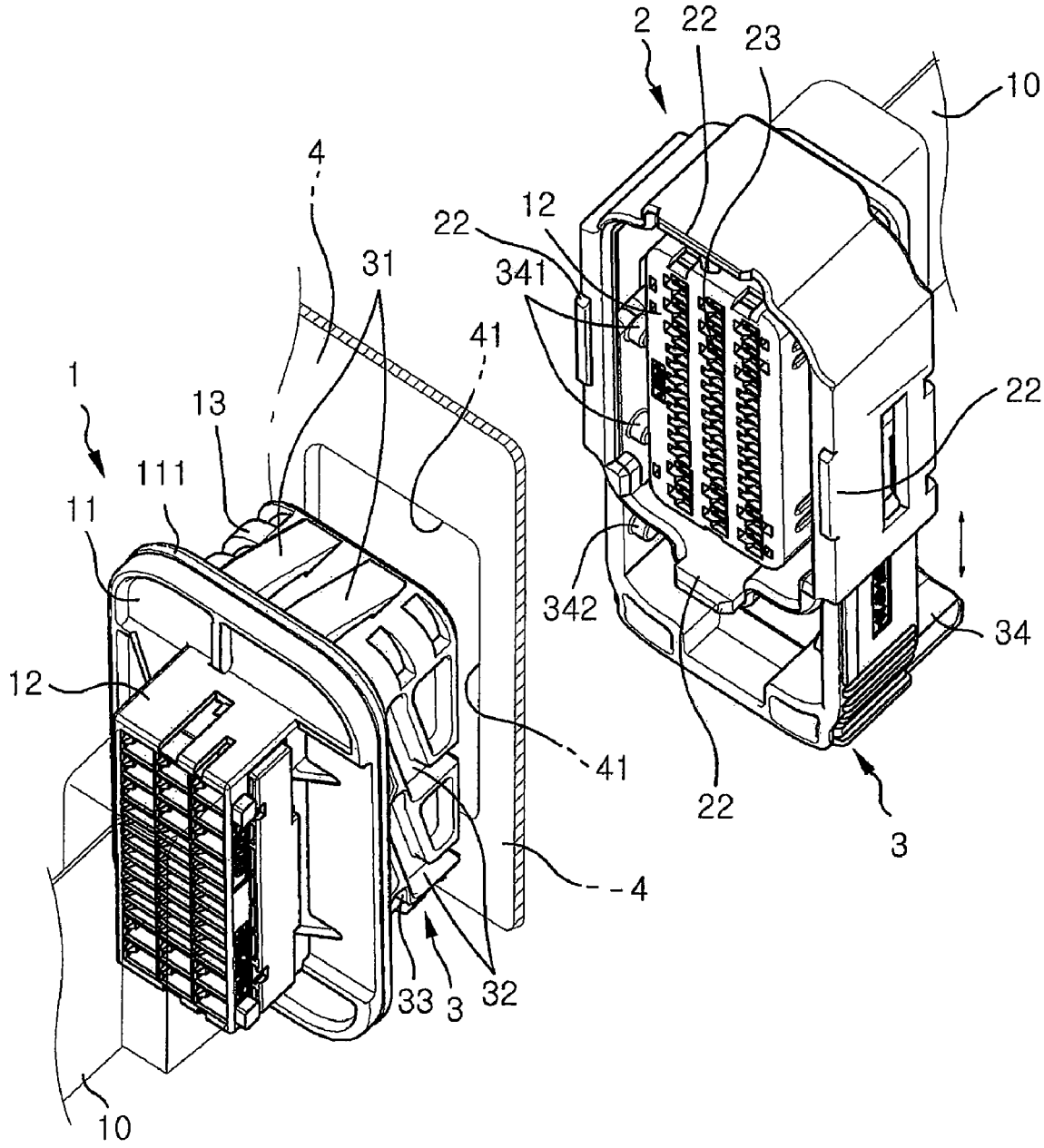
FIG. 4 is an exploded perspective view of a cable connector according to a second embodiment of the present invention.
Figure 5:
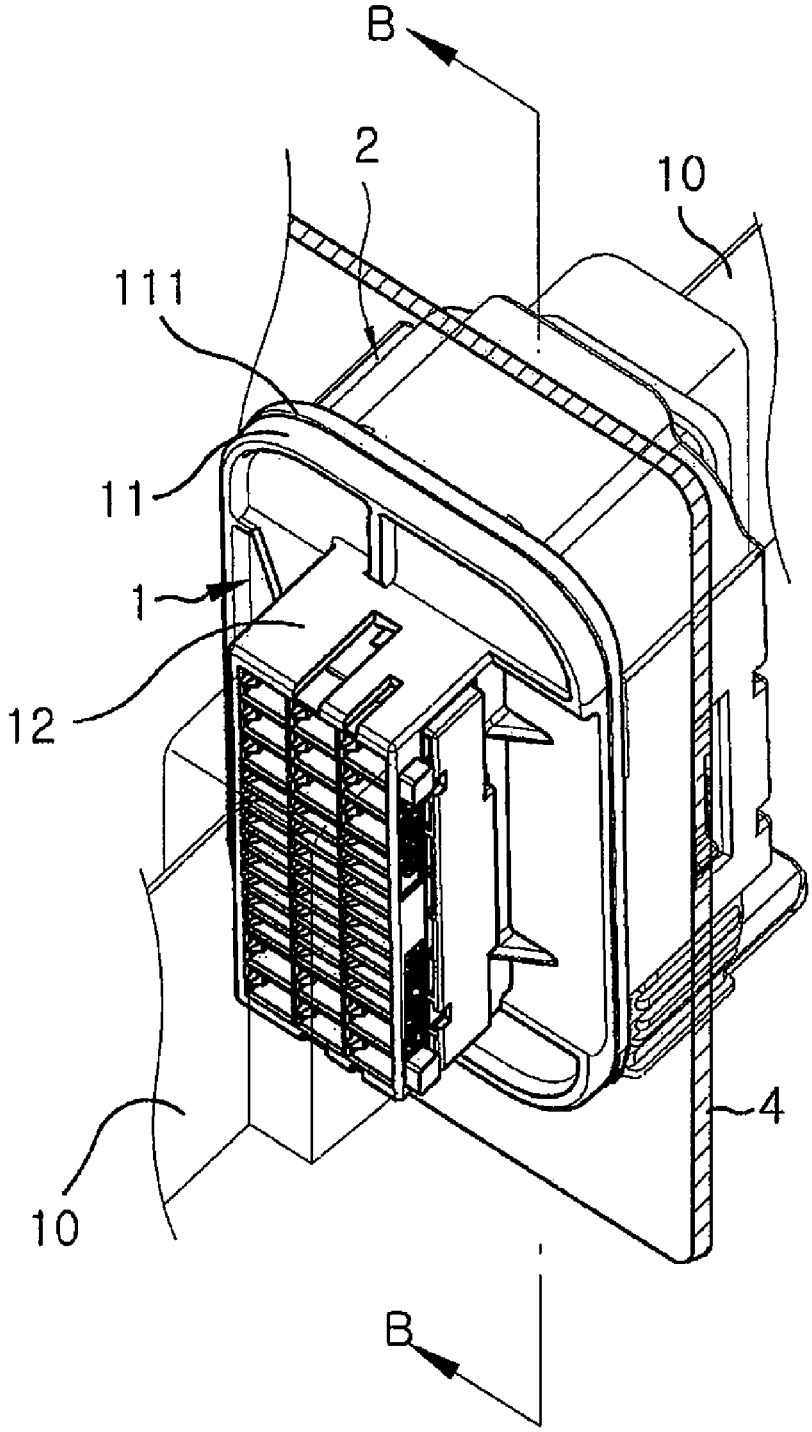
FIG. 5 is a perspective view of the cable connector of FIG. 4 shown in an assembled state.
Figure 6:
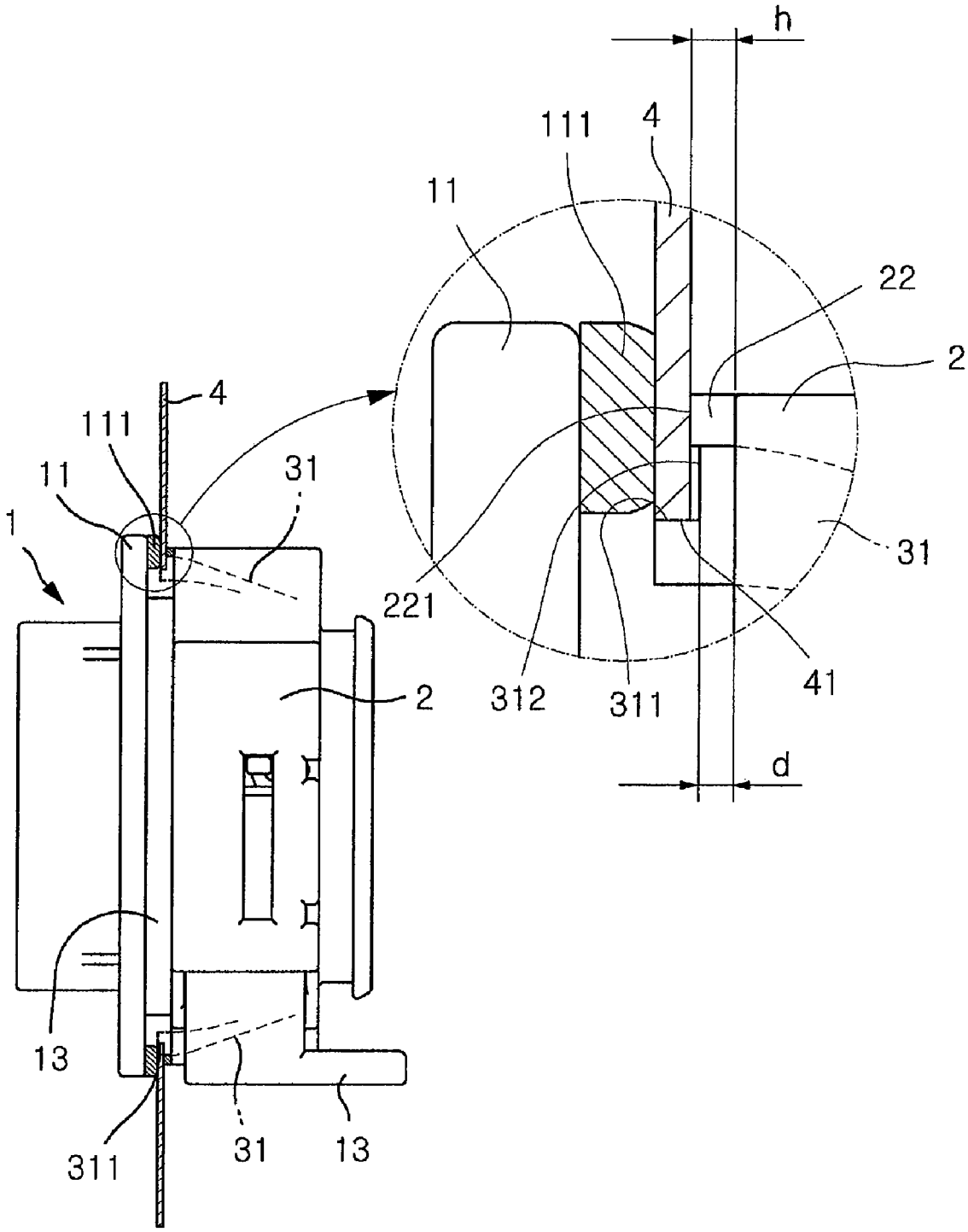
FIG. 6 is a partial sectional view taken along line B-B in FIG. 5.

As shown in FIG. 4, the cable connector according to the second embodiment is formed to have protruding portions 22. As shown in FIG. 6, the protruding portions 22 have a protruding length h which is equal to or longer than the distance d between the end of the second connector 2 and the latching end 312 of the latching recess 311 when the second connector 2 and the first connector 1 are engaged. In other words, the protruding length h is a length from the end of the second connector 2 to an end 221 of the protruding portions 22. By the protruding length h, which is equal to or longer than the above distance d, an end 221 of the protruding portions 22 securely and closely contacts the panel 4 to press the panel 4 of the vehicle body so that the end of the connector mounting opening 41 can be perfectly fitted in the latching recesses 311 of the elastic members 31 when the second connector 2 and the first connector 1 are engaged with each other. Although multiple protruding portions 22 are illustrated in the drawings, it will be appreciated by those skilled in the art that the protruding portion 22 may alternatively be provided as a single body, which protrudes from the whole circumference of the end of the second connector 2.

Figure 7A:
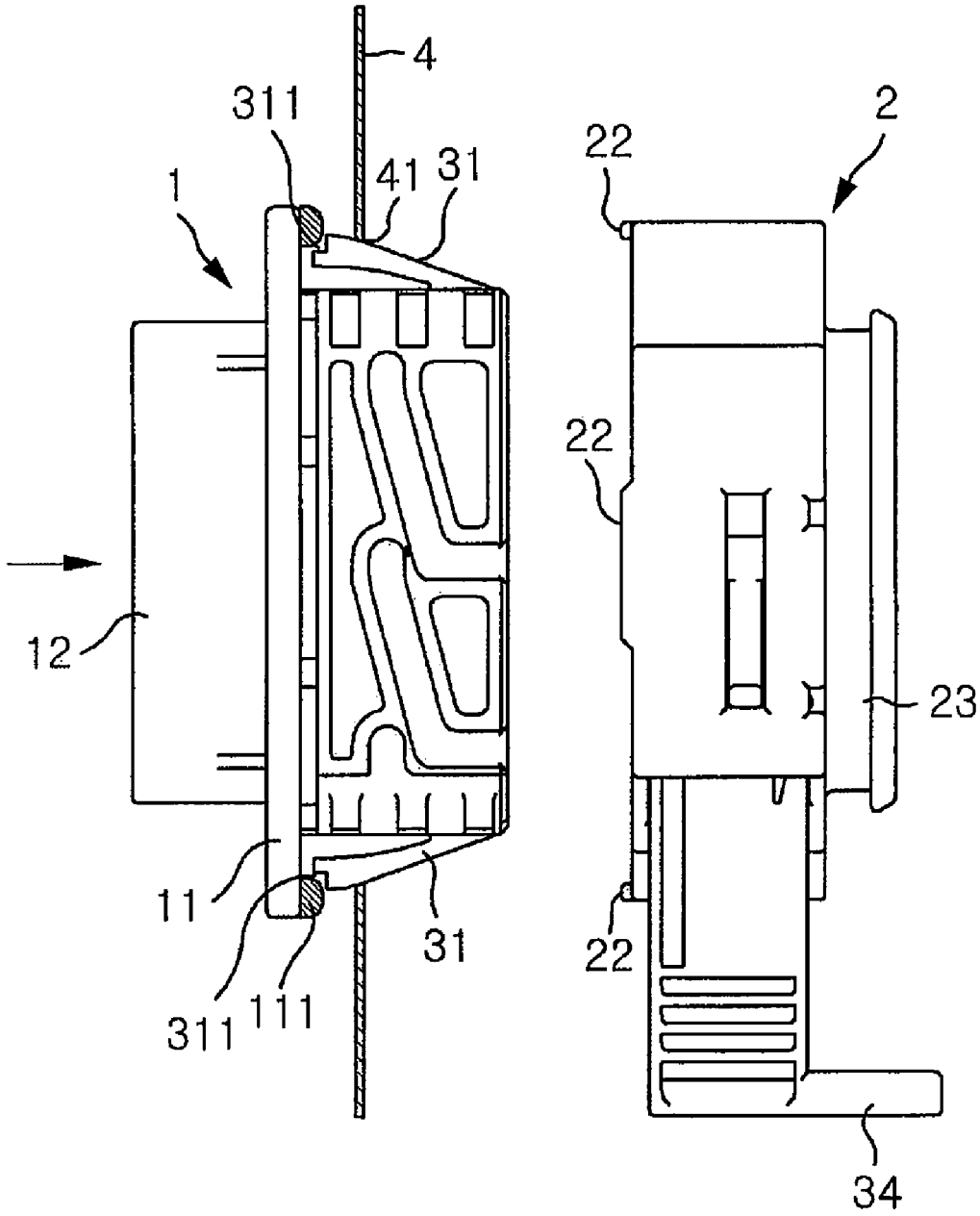
FIG. 7*a* is a schematic illustration of the cable connector of FIG. 4 shown being assembled to a panel of a vehicle body.
Figure 7B:
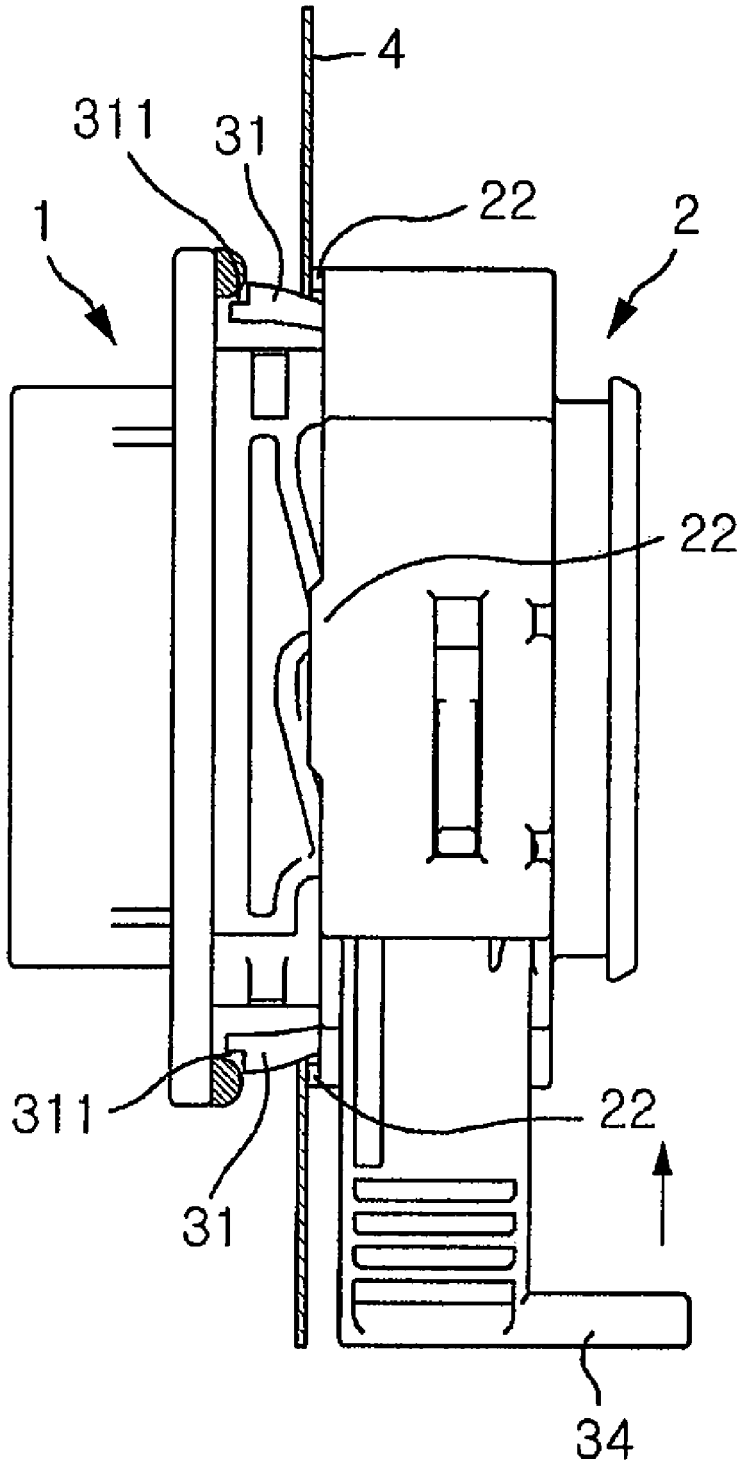
FIG. 7*b* is a schematic illustration of the cable connector of FIG. 4 shown being assembled to a panel of a vehicle body.
Figure 7C:
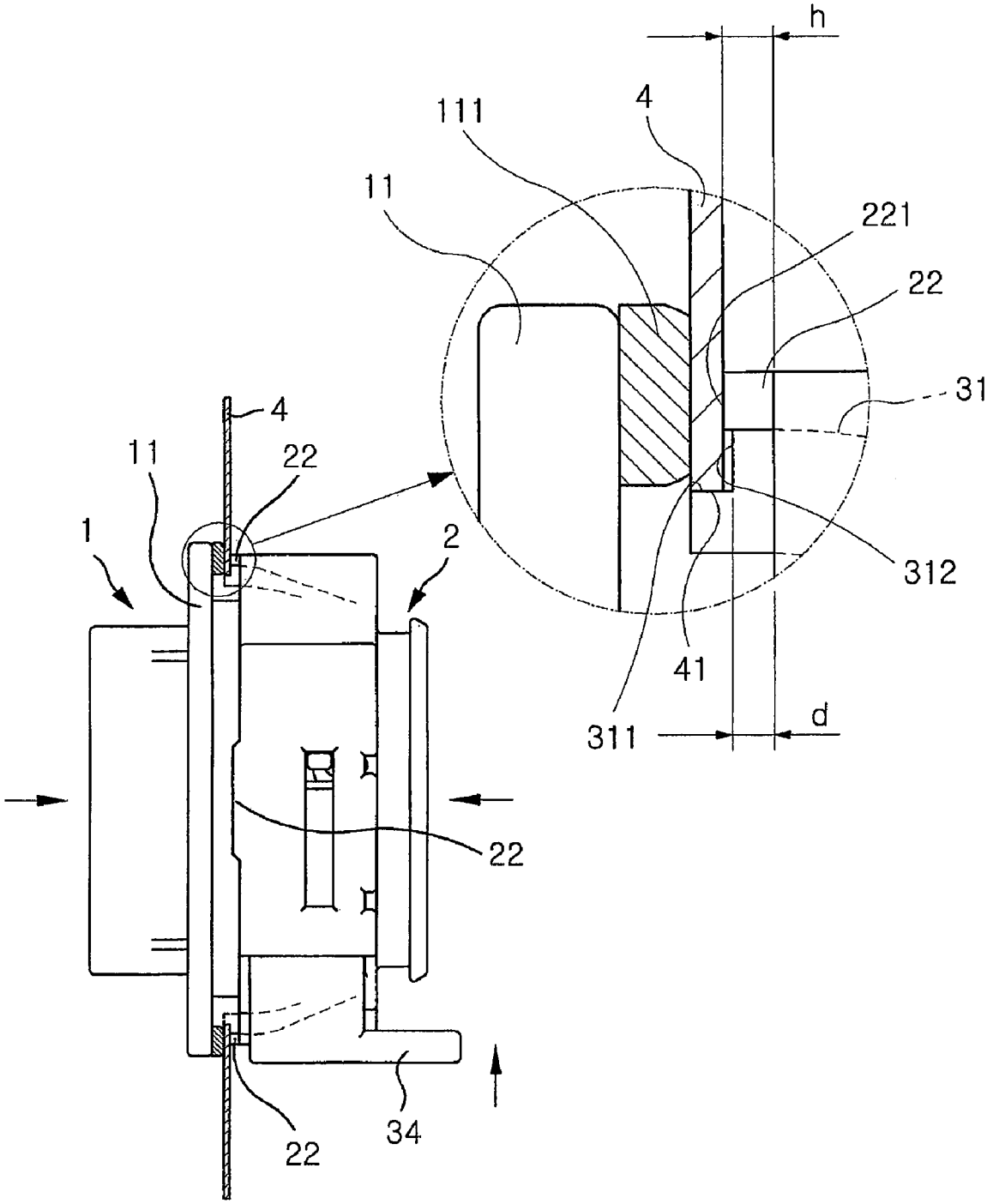
FIG. 7*c* is a schematic illustration of the cable connector of FIG. 4 shown assembled to the panel of the vehicle body.
Figure 8:
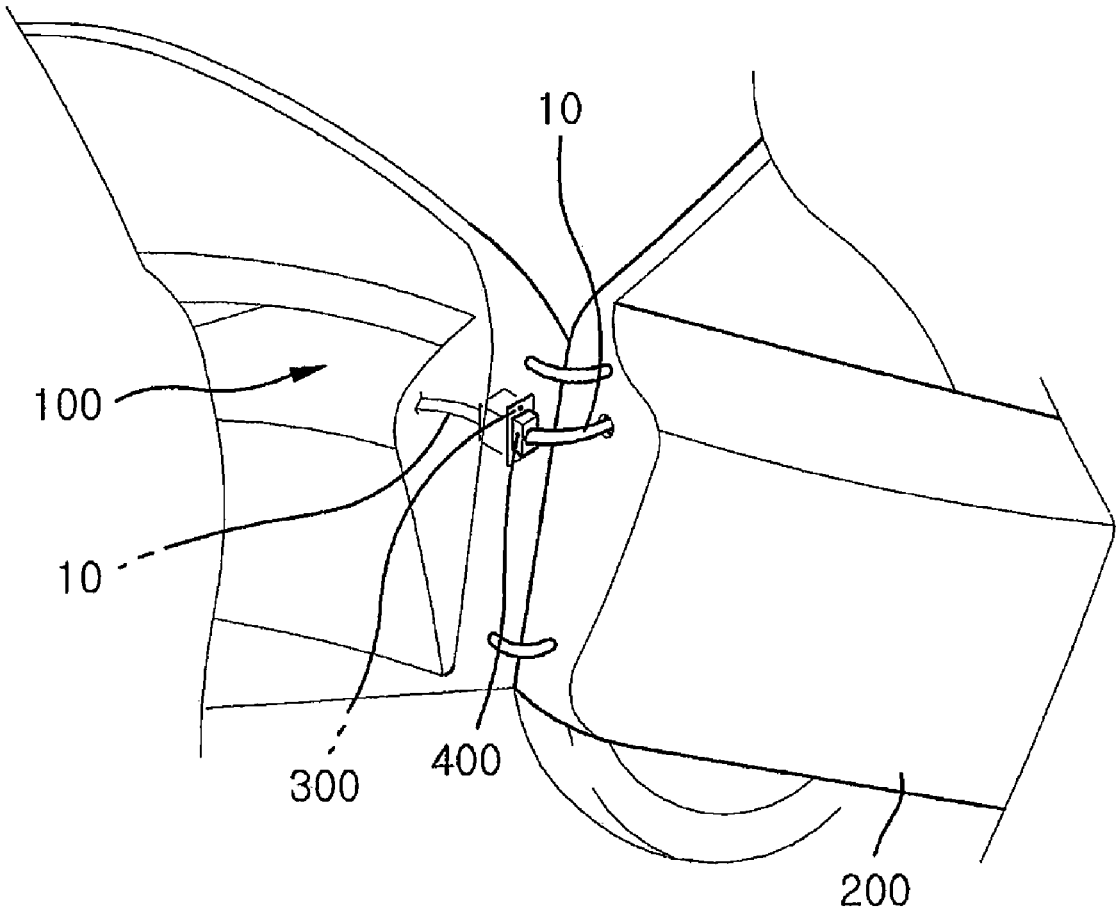
Fig.8 Prior Art
FIG. 8 is a schematic illustration a conventional cable connector shown installed in a vehicle.
Figure 9:
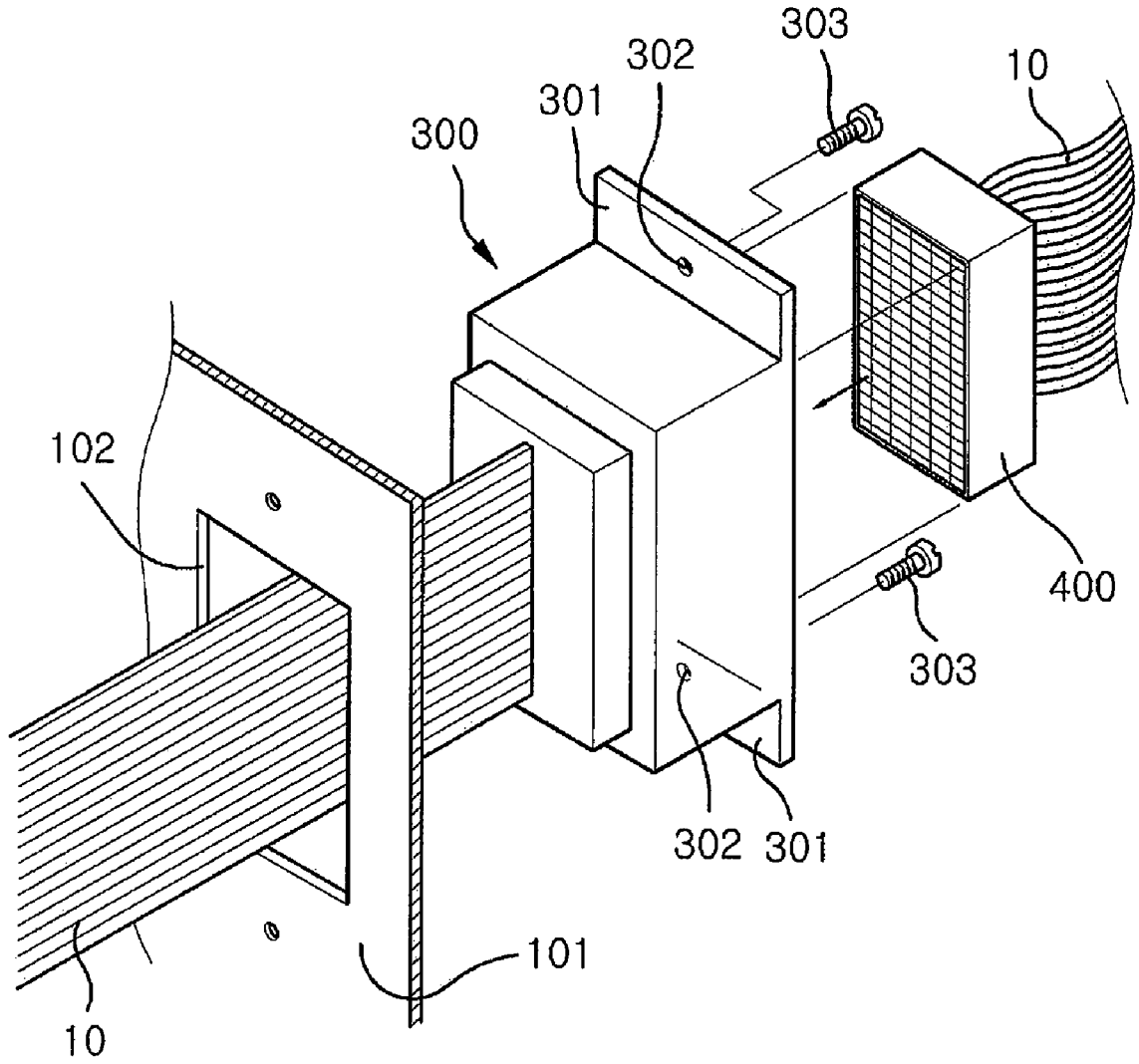
Fig.9 Prior Art
FIG. 9 is an exploded perspective view of the conventional cable connector of FIG. 8.

Hereinafter, a process of assembling the cable connector according to the second embodiment of the present invention will be described with reference to FIGS. 7*a*-7*c*. The process of assembling the cable connector according to the second embodiment of the present invention will be described on the assumption that the first connector 1 is not perfectly fitted through the connector mounting opening 41 of the panel 4 of the vehicle body due to a worker's assembly mistake, as shown in FIG. 7*a*, and the second connector 2 is temporarily engaged with the fitting member 13 of the first connector 1, as shown in FIG. 7*b*.

By manipulating the slide lever 34, the protruding portion 22 of the second connector 2 pushes the panel 4 of the vehicle body. As the second connector 2 pushes the panel 4 of the vehicle body, the first connector 1 is pulled toward the second connector 2 by the protruding portion 22 of the second connector 2 pushing the panel 4 of the vehicle body, and the elastic members 31 provided at the first connector 1 are bent inwardly. At the moment when the first connector 1 is completely pulled, the end of the connector mounting opening 41 of the panel 4 of the vehicle body is fitted in the latching recesses 311 of the elastic members 31. Accordingly, the second connector 2 and the first connector 1 can be assembled without a defect. Thus, in the state where the first connector 1 is not perfectly installed to the panel 4 of the vehicle body, the end of the connector mounting opening 41 can be fitted in the latching recesses 311 of the elastic members 31 through the operation of the slide lever 34.

Because the protruding length h of the protruding portion 22 formed on the end of the second connector 2 is equal to or longer than the distance d between the end of the second connector 2 and the latching end 312 of the latching recess 311 when the second connector 2 and the first connector 1 are engaged, at the moment when the first connector 1 is completely pulled, the end of the connector mounting opening 41 of the panel 4 of the vehicle body is securely fitted in the latching recesses 311 of the elastic members 31. Accordingly, through the engaging process of the second connector 2, the first connector 1 can be securely fixed through the connector mounting opening 41 of the panel 4 of the vehicle body without a defect.

Further, the waterproof seal 111 provided on the flange 11 of the first connector 1 can closely contact the panel 4 of the vehicle body because the protruding length h of the protruding portion 22 is equal to or longer than the distance d between the end of the second connector 2 and the latching end 312 of the latching recess 311. As a result, a waterproof effect can be improved to the maximum through the waterproof seal 111 provided on the flange 11.

The cable connector according to the first and second embodiments of the present invention can improve an assembly efficiency of the cable connector by enabling a worker to securely install the first connector 1 to the panel of the vehicle body by only the engaging process of the second connector 2 and the first connector 1 without using a coupling member, such as a bolt. Further, since the end of the connector mounting opening 41 is securely fitted in the latching recesses 311 of the elastic members 31 formed on the first connector 1 through one manipulation of the slide lever 34 in the engaging process of the second connector 2 and the first connector 1, an assembly defect of the cable connector can be prevented in advance.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A cable connector for a vehicle door, comprising:

a first connector including a first contact terminal and a fitting member, the fitting member having at least one cam recess, at least one locking recess, and at least one elastic member, the elastic member having at least one latching recess that engages an edge of a connecter mounting opening of a panel of a vehicle body, the first contact terminal and the fitting member having a flange with a waterproof seal provided there between;

a second connector engaged with the fitting member of the first connector, the second connector including a second contact terminal and a slide lever, the slide lever having at least one guide protrusion and at least one locking protrusion, the slide lever being slideable to move the guide protrusion along the cam recess and lock the locking protrusion in the locking recess; and the elastic member is received within the second connector and the latching recess of the elastic member protrudes from an end of the second connector such that a gap is formed between the latching recess and the end of the second connector.

2. The cable connector of claim 1, wherein the first connector is a male connector and the second connector is a female connector.

3. The cable connector of claim 1, wherein the second connector has at least one protruding portion extending toward the first connector that engages the panel of the vehicle body.

4. The cable connector of claim 3, wherein the protruding portion has a protruding length which is equal to or longer than a distance of the gap formed between the latching recess and the end of the second connector.

* * * * *